US007241189B2

(12) United States Patent
Mohs et al.

(10) Patent No.: US 7,241,189 B2
(45) Date of Patent: Jul. 10, 2007

(54) HIGH-CURRENT TERMINAL BLADE TYPE CONNECTOR

(75) Inventors: Wolfgang Mohs, Iserlohn (DE); Patrick Heinemann, Iserlohn (DE)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 11/516,360

(22) Filed: Sep. 6, 2006

(65) Prior Publication Data

US 2007/0066152 A1 Mar. 22, 2007

Related U.S. Application Data

(63) Continuation of application No. PCT/EP2005/003221, filed on Mar. 26, 2005.

(30) Foreign Application Priority Data

Mar. 30, 2004 (DE) ..... 10 2004 015 345

(51) Int. Cl.
*H01R 13/187* (2006.01)

(52) U.S. Cl. ..... 439/845

(58) Field of Classification Search ..... 439/845, 439/852, 843, 854, 855
See application file for complete search history.

(56) References Cited

U.S. PATENT DOCUMENTS

| | | | | |
|---|---|---|---|---|
| 4,413,873 | A | 11/1983 | Karl | |
| 5,088,942 | A | 2/1992 | Welsh et al. | |
| 5,545,842 | A | 8/1996 | Balsells | |
| 6,261,119 | B1 * | 7/2001 | Green | 439/425 |
| 6,634,794 | B1 * | 10/2003 | Daoud et al. | 385/53 |
| 6,692,316 | B2 | 2/2004 | Hsieh et al. | |
| 7,150,660 | B2 * | 12/2006 | Allgood et al. | 439/845 |
| 2003/0060090 | A1 | 3/2003 | Allgood et al. | |
| 2003/0073354 | A1 | 4/2003 | Hotea | |

FOREIGN PATENT DOCUMENTS

| | | |
|---|---|---|
| DE | 26 34 406 | 2/1977 |
| DE | 39 06 625 C1 | 1/1990 |
| DE | 195 18 828 A1 | 11/1996 |
| DE | 100 14 116 A1 | 9/2001 |
| EP | 0 649 994 A1 | 4/1995 |
| EP | 0 649 994 A1 | 1/1998 |
| EP | 0 856 913 A1 | 8/1998 |
| EP | 1 107 377 A1 | 6/2001 |
| EP | 1 202 392 A1 | 5/2002 |

* cited by examiner

*Primary Examiner*—Chandrika Prasad
(74) *Attorney, Agent, or Firm*—Brooks Kushman P.C.

(57) ABSTRACT

An electrical socket contact for high-current applications includes a cage-like receptacle housing having two lateral plates on opposite sides. The lateral plates forming an interspace therebetween for holding a complementary plug contact. The socket contact further includes a contact plate insert arranged within the interspace of the lateral plates of the housing. The contact plate insert has a contact plate body extending parallel to the lateral plates of the housing. The contact plate body has a base and first and second contact plates. Each contact plate has first and second ends. The first ends of the contact plates are connected to the base of the contact plate body and the second ends of the contact plates each has a contact zone projecting away from the base of the contact plate body.

20 Claims, 1 Drawing Sheet

HIGH-CURRENT TERMINAL BLADE TYPE CONNECTOR

CROSS-REFERENCE TO RELATED APPLICATIONS

This is a continuation of International Application PCT/EP2005/003221, published in German, with an international filing date of Mar. 26, 2005, which claims priority to DE 10 2004 015 345.0, filed Mar. 30, 2004, the disclosures of which are both hereby incorporated by reference.

BACKGROUND OF THE INVENTION

1. Field of the Invention

The present invention relates to an electrical socket contact for high-current applications in which the socket contact includes a cage-like receptacle housing formed by two lateral plates on opposite sides and includes a contact plate insert arranged within the housing in which the contact plate insert has a contact plate body extending parallel to the lateral plates and in which contact zones connected to the contact plate body protrude out from the contact plate body.

2. Background Art

An electrical socket (or receptacle) contact is part of an electrical plug-and-socket connector. Plug-and-socket connectors are used, for example, in motor vehicles. Plug-and-socket connectors for high-current applications are larger than plug-and-socket connectors for low-current or electronic applications.

U.S. Pat. No. 6,692,316 describes an electrical socket contact for high-current applications. The socket contact includes a cage having a U-shaped cross-section with a U-shaped opening. A contact plate insert inserts into the cage through the opening and electronically connects with the cage. The contact plate insert is also U-shaped and includes two separated contact plate bodies having protruding contact plates. An opening is between the contact plates for holding a plug contact, such as a blade contact, complementary to the socket contact.

The contact plates of each contact plate body are exposed by punching them out to extend from one end at the top edge of the contact plate body to the other end at the lower edge of the contact plate body. Thus, each contact plate body forms a frame for the contact plates which are attached to the contact plate body on both of their ends. The contact plates are stamped to form contact zones which flare out from the contact plate body toward the blade contact to be inserted. The contact plates are bent by a few angular degrees about the axes of their longitudinal extension in the area of their middle section to make them flare out. Such a contact plate insert can have the blade contact pushed into it parallel to the orientation of the contact plates and thus from the top or from the side of them toward which slanting sides of the contact plates point. The contact plate insert can be inserted in the cage in two different orientations to make it possible to make contact with the cage from the top and right or from the top and left depending on the intended user of the contact plate insert. This socket contact has the advantage that it can be mounted to enable contact from different directions using the same elements.

The cage has a cutout made in the area of the U-shaped bend which serves for the engagement of a locking bar or pin associated with a housing to hold the socket contact with the socket contact inserted therein. This locking bar or pin is intended to lock the socket contact within the housing. Thus, when the socket contact is assembled into the housing, it is necessary to make sure that both elements are brought together in the correct position. For this reason it is not possible to make contact with the socket contact from this side of the housing.

SUMMARY OF THE INVENTION

An object of the present invention is to provide an electrical socket (receptacle) contact which enables contact with the socket contact from different directions independently of the mounting of a contact plate insert.

In carrying out the above object and other objects, the present invention provides an electrical socket contact for high-current applications. The socket contact includes a housing having two lateral plates on opposite sides. The lateral plates form an interspace therebetween for holding a complementary plug contact. A contact plate insert is arranged within the interspace of the lateral plates of the housing. The contact plate insert has at least one contact plate body extending parallel to the lateral plates of the housing. The contact plate body has a base and a plurality of first and second contact plates. Each contact plate has a first end and a second end. The first ends of the contact plates are connected to the base of the contact plate body and the second ends of the contact plates each has a contact zone projecting away from the base of the contact plate body.

In accordance with an embodiment of the present invention, the electrical socket (receptacle) contact includes a contact plate insert having a contact plate body in which contact plates connected on one end to the contact plate body project from the contact plate body such that the contact zone of each contact plate is in the area of the free end of the contact plate which is not connected to the contact plate body. That is, the contact plates include a first end and a second (free) end. The contact plates are connected at their first end to their contact plate body. Thus, the contact plates form projections extending away from the area of the contact plate body where they connect to the contact plate body. The contact zone of a contact plate is located in the area of the free end of the projection of the contact plate. A contact plate insert with contact plates made in this way is simpler to produce and allow precisely defined contact zones to be formed.

Connecting the contact plates to their contact plate body on only one side (end) allows the contact plates to have their longitudinal extension oriented in different directions. For example, the contact plates can be arranged to extend toward one another radially. As such, it is possible to design the contact plate insert without specifying certain predefined plugging directions. Further, it is possible for a complementary blade contact to make contact with such a contact plate insert as intended independent of the direction from which the blade contact is brought together with the contact plate insert. Because the contact plate insert is located in the cage-like socket housing, the plugging directions are ultimately determined by the plug openings of the housing. Generally, the housing has three plug openings.

As indicated, the contact plates are in the form of projections extending away from their contact plate body. Therefore, it is easy to shape the free end of a contact plate to form a contact zone and a ramp surface. In order to have the same plugging conditions independent of the plugging direction of the complementary blade contact it is expedient to arrange the contact zones of the contact plates to form a circular structure. For the case in which the contact plates have different lengths, it is expedient to arrange the contact zones of the contact plates to form concentric ring structures such as two ring structures.

Providing contact plates connected to a contact plate body at one end makes it possible to keep open a central area of the contact plate insert. If the primary locking opening of the housing is centrally located within each side surface, then a locking pin provided for primary locking can engage into the primary locking opening with greater tolerance without damaging contact plates located below the primary locking opening and without preventing plugging as intended.

BRIEF DESCRIPTION OF THE DRAWINGS

An embodiment of the present invention described below makes reference to the following figures.

DETAILED DESCRIPTION OF THE PREFERRED EMBODIMENT(S)

Figure 1:
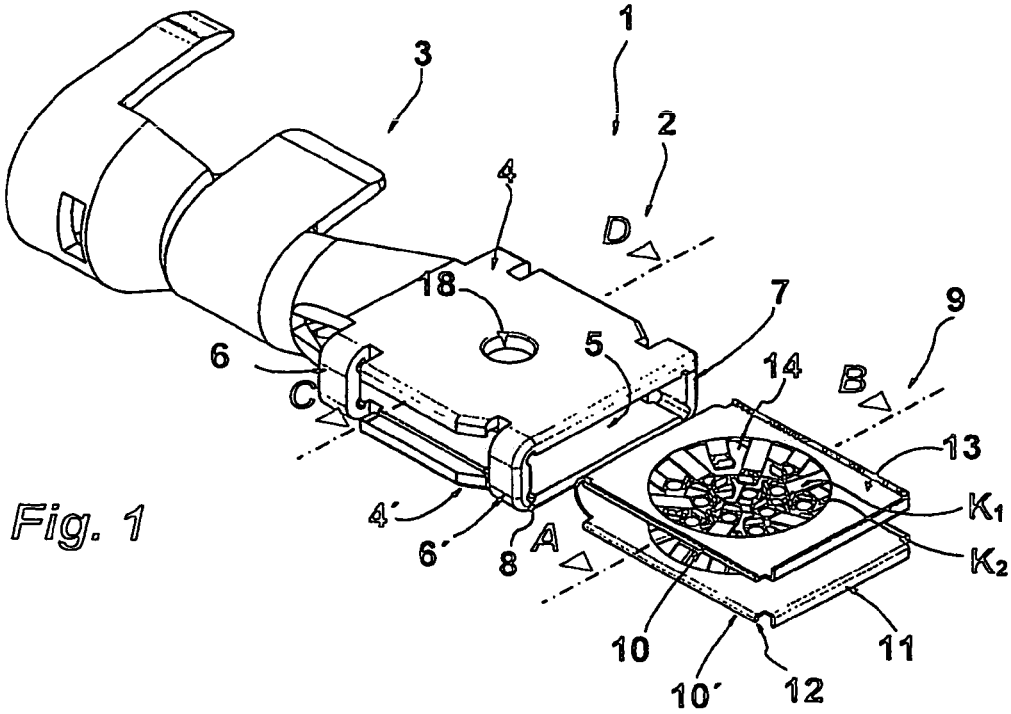
FIG. 1 illustrates a perspective view of an electrical socket contact having a housing, a crimp section, and a contact plate insert in which the contact plate insert is removed from the housing.

Referring now to FIG. 1, an electrical socket (receptacle) contact 1 in accordance with an embodiment of the present invention is shown. Socket contact 1 includes a socket (receptacle) housing 2. Housing 2 generally has a three-dimensional rectangular configuration. Housing 2 includes two lateral plates 4, 4'. Lateral plates 4, 4' generally have corresponding rectangular or square surface areas bounded by four sides. Lateral plates 4, 4' are spaced apart from one another and run parallel to one another to define an interspace therebetween. Lateral plates 4, 4' border an opening 5 on a first side of housing 2 and border three other openings on the remaining three sides of the housing. Each opening leads into the interspace between lateral plates 4, 4'. Opening 5 serves as a front face of the housing.

A crimping extension 3 is integral with the opening on the second side of housing 2 which is opposite to opening 5. Crimping extension 3 connects an electrical conductor such as a cable to socket contact 1.

A pair of oppositely faced bridges 6 at the second side of housing 2 connect the sides of lateral plates 4, 4' at the second housing side. Likewise, a pair of oppositely faced bridges 6' at the first side of housing 2 connect the sides of lateral plates 4, 4' at the first housing side. Lateral plate 4' includes support bars 7 which define the arrangement of lateral plates 4, 4' to one another. Support bars 7 are respectively arranged with bridges 6, 6'. The ends of lateral plate 4 lie on the top ends of support bars 7.

Housing 2 and crimping extension 3 together form a base body of socket contact 1. The base body of socket contact 1 is made out of a single piece of sheet metal. After stamping, the base body of socket contact 1 is turned over in its form illustrated in FIG. 1. Bending grooves 8 made in the sheet metal strips beforehand define edge axes to create housing 2. In FIG. 1, a bending groove is identified with the reference numeral 8. Bending grooves 8 continue in guide grooves inside lateral plates 4, 4'.

Socket contact 1 includes a contact plate insert 9. Contact plate insert 9 is also made out of a sheet metal strip. Contact plate insert 9, in the illustrated embodiment, includes two contact plate bodies 10, 10'. Contact plate bodies 10, 10' generally have corresponding rectangular or square shaped peripheries. The peripheries of contact plate bodies 10, 10' generally correspond to the peripheries of lateral plates 4, 4' and are no larger than the peripheries of the lateral plates. Each contact plate body 10, 10' includes a base body 13 having four sides. A circular-shaped plate space 14 is in the middle of base body 13 of each contact plate body 10, 10'. Contact plate bodies 10, 10' are arranged in respective planes running parallel to one another with an interspace therebetween.

Contact plate insert 9 is to be inserted within the interspace of housing 2. Contact plate insert 9 is U-shaped as contact plate bodies 10, 10' are connected together at first sides. The connected first sides form a reverse bend. The reverse bend points toward and is adjacent to crimp section 3 when contact plate insert 9 is inserted within the interspace of housing 2. When contact plate insert 9 is inserted within the interspace of housing 2, contact plate bodies 10, 10' extend parallel to lateral plates 4, 4' of the housing.

The edges of each of the other three sides of each contact plate body 10, 10' bend out substantially perpendicularly from the plane of the contact plate body and away from the interspace between contact plate bodies 10, 10'. The bent edges of the second sides of contact plate bodies 10, 10', which are opposite to the first sides of the contact plate bodies, form front bends 11. The bent edges of the remaining third and fourth sides of contact plate bodies 10, 10', which are opposite to one another and perpendicular to the first and second sides of contact plate bodies 10, 10', form side bends 12. The sectional illustration of FIG. 2 also identifies bends 11, 12.

Front bends 11 serve as stops which cooperate with the front face of housing 2 to limit the insertion depth of contact plate insert 9 through opening 5 into the interspace between lateral plates 4, 4' of the housing. Side bends 12 engage into bending grooves 8 or the guide grooves inside lateral plates 4, 4' when contact plate insert 9 is inserted into housing 2. Thus, side bends 12 fix contact plate insert 9 inside the interspace between lateral plates 4, 4' of housing 2.

Figure 2:
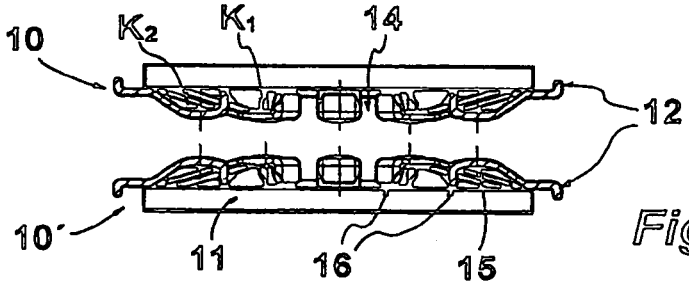
FIG. 2 illustrates a cross-section of the contact plate insert along the line A-B of FIG. 1.

Referring now to FIG. 2, with continual reference to FIG. 1, contact plate bodies 10, 10' of contact plate insert 9 will be described in greater detail. Contact plate bodies 10, 10' have corresponding structures and, as such, only contact plate body 10 will be described in greater detail. Contact plate body 10 includes a plurality of contact plates K1, K2. Contact plates K1, K2 have different lengths with contact plates K1 being longer than contact plates K2. Contact plates K1, K2 are projections of base body 13 of contact plate 10. Contact plates K1, K2 each include a first (connected) end and a second (free) end. Contact plates K1, K2 are connected at their first ends to base body 13 of contact plate body 10. Contact plates K1, K2 are alternatively arranged, extending toward one another radially. Contact plates K1, K2 project into plate space 14 in base body 13 of contact plate body 10. In the illustrated embodiment, plate space 14 is circular but can have other geometries as desired.

Contact plates K1, K2 each have a bulging shape 15. Each bulge 15 forms a contact zone in the area of the second free end of contact plate K1, K2 (i.e., the end of the contact plate which is not connected to base body 13 of contact plate body 10). Each bulge 15 has a stamped contact bead. Bulges 15 and the contact beads of contact plate body 10 point toward the other contact plate body 10'. Each free end of contact plate K1, K2 is shaped into a supporting bend 16 which is slightly separated from the plane of the inner wall side of contact plate body 10 in the direction toward opening 5. This ensure that it is easy to push contact plate insert 9 through opening 5 of housing 2 and into the interspace between lateral plates 4, 4' of the housing.

Figure 3:
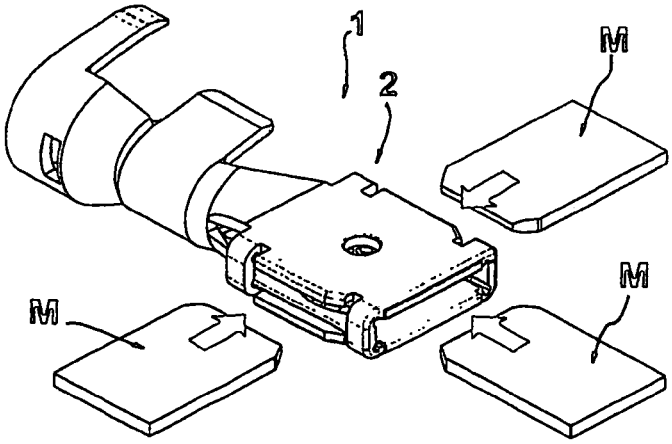
FIG. 3 illustrates the socket contact and individual complementary blade contacts being brought together with the socket contact from different directions to make electrical contact with the socket contact.

In FIG. 3, contact plate insert 9 is inserted through opening 5 of housing 2 to be arranged within the interspace between lateral plates 4, 4' of the housing. The forms of contact plate insert 9 and housing 2 allow a blade contact M to make direct electrical contact with socket contact 1 from three different directions. This is possible without first having to insert contact plate insert 9 into opening 5 in a certain orientation. If contact plate bodies 10, 10' are connected together with lugs at their connecting end, it is possible to make contact with contact plate insert 9 from four directions.

Figure 4:
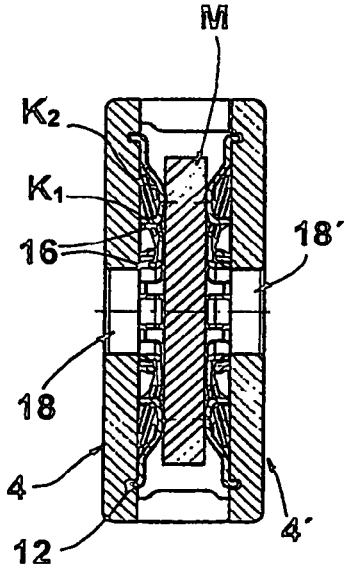
FIG. 4 illustrates a complementary blade contact inserted within the contact plate insert and the housing to make electrical contact with the socket contact in a cross-sectional illustration along the line C-D of FIG. 1.

With reference to FIGS. 3 and 4, bringing a blade contact M into contact with socket contact 1 involves guiding the front face of the blade contact into its intended contact position in cooperation with supporting bends 16 of contact plates K1, K2 and the contact beads. Guide beads in the area of base body 13 can provide additional guidance to blade contact M as it is pushed in. It is expedient for the thickness of blade contact M to be selected so that it causes supporting bends 16 of contact plates K1, K2 to come to lie against the inner surface of lateral plates 4, 4'. Then the contact zones of the individual contact plates K1, K2 each form a contact bulge 15 supported against the inside of lateral plates 4, 4' with a short extension so that the outer surface of blade contact M can make contact with a correspondingly high contact force. As a result, blade contact M makes contact with a large number of contact zones.

Lateral plates 4, 4' of housing 2 respectively have a primary locking opening 18, 18' in the middle of each lateral plate 4, 4'. Primary locking openings 18, 18' serve for primary locking of socket contact 1 in another housing when the socket contact is inserted into this housing. Socket contact 1 is locked in the other housing by a single locking pin that engages into one of primary locking openings 18, 18'. The symmetrical arrangement of primary locking openings 18, 18' enables socket contact 1 to be inserted into the housing without taking the orientation of the socket housing into consideration.

In the embodiment, the connection cable is rotated a maximum of 90° to bring socket contact 1 into the correct position when it comes in from an oblique angle. This is easily possible, even when a high-current cable is connected.

LIST OF REFERENCE NUMBERS

1 Socket (Receptacle) contact
2 Socket (Receptacle) housing
3 Crimping extension
4, 4' Lateral plate
5 Opening
6, 6' Bridges
7 Support bar
8 Bending groove
9 Contact plate insert
10, 10' Contact plate body
11 Bend
12 Bend
13 Base body
14 Plate space
15 Bulge
16 Supporting bend
18, 18' Primary locking opening
K1, K2 Contact plate
M Blade contact While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. A high-current terminal blade type connector comprising:

a housing having two parallel spaced-apart lateral plates connected to one another to form an interspace therebetween for holding a plug contact, wherein the lateral plates have corresponding rectangular surfaces bounded by four sides, wherein each pair of corresponding sides of the lateral plates respectively borders an opening leading into the interspace such that four openings lead into the interspace, wherein a plug contact is insertable through any one of the openings to be arranged within the interspace; and a contact plate insert arranged within the interspace of the lateral plates of the housing, the contact plate insert having a contact plate body extending parallel to the lateral plates of the housing;

the contact plate body having a base and a plurality of first and second contact plates, each contact plate having a first end and a second end, the first ends of the contact plates being connected to the base of the contact plate body and the second ends of the contact plates each having a contact zone projecting away from the base of the contact plate body in a direction toward one of the lateral plates to make contact with a plug contact arranged within the interspace of the lateral plates.

2. The connector of claim 1 wherein:

the contact plates extend toward one another radially.

3. The connector of claim 1 wherein:

the contact zones of the contact plates form a ring structure.

4. The connector of claim 1 wherein:

each contact zone forms a bulge having a contact bead.

5. The connector of claim 1 wherein:

the contact zones of the contact plates form a circular structure.

6. The connector of claim 1 wherein:

the lateral plates have a centrally arranged locking opening in them;

wherein the locking opening has a passageway, wherein a locking pin running through the passageway intersects neither the contact plates nor the base of the contact plate body when the contact plate insert is arranged within the housing.

7. The connector of claim 1 wherein:

the housing has the form of a cage.

8. The connector of claim 1 wherein:

the contact plate insert is U-shaped.

9. The connector of claim 1 wherein:

the first contact plates have a different length than the second contact plates.

10. The connector of claim 1 further comprising:

a crimping extension integral with one of the openings leading into the interspace between the lateral plates of the housing.

11. A high-current terminal blade type connector comprising:

a housing having two parallel spaced-apart lateral plates connected to one another to form an interspace therebetween for holding a plug contact, wherein the lateral plates have corresponding surfaces bounded by four sides, wherein each pair of corresponding sides of the lateral plates respectively borders an opening leading into the interspace such that four openings lead into the interspace; and a contact plate insert arranged within the interspace of the lateral plates of the housing, the contact plate insert having a pair of spaced apart contact plate bodies which are connected at one end to form a reverse bend bordering one of the openings leading into the interspace and which run parallel to one another and extend parallel to the lateral plates of the housing, wherein a plug contact is insertable through any one of the three remaining openings to be arranged within the interspace of the lateral plates;

each contact plate body having a base and a plurality of first and second contact plates, each contact plate having a first end and a second end, the first ends of the contact plates being connected to the base of the contact plate body and the second ends of the contact plates each having a contact zone projecting away from the base of the contact plate body in a direction toward one of the lateral plates to make contact with a plug contact arranged within the interspace of the lateral plates.

12. The connector of claim 11 wherein:

the contact plates extend toward one another radially.

13. The connector of claim 11 wherein:

the contact zones of the contact plates form a ring structure.

14. The connector of claim 11 wherein:

each contact zone forms a bulge having a contact bead.

15. The connector of claim 11 wherein:

the contact zones of the contact plates form a circular structure.

16. The connector of claim 11 wherein:

the lateral plates have a centrally arranged locking opening in them;

wherein the locking opening has a passageway, wherein a locking pin running through the passageway intersects neither the contact plates nor the contact plate bodies when the contact plate insert is arranged within the housing.

17. The connector of claim 11 wherein:

the first contact plates have a different length than the second contact plates.

18. The connector of claim 11 wherein:

the housing has the form of a cage.

19. The connector of claim 11 further comprising:

a crimping extension integral with one of the openings leading into the interspace between the lateral plates of the housing.

20. The connector of claim 11 wherein:

the contact plate insert is U-shaped.

* * * * *